US007507908B1

(12) United States Patent
Wu et al.

(10) Patent No.: US 7,507,908 B1
(45) Date of Patent: Mar. 24, 2009

(54) CABLE OF EASY COLLECTION

(75) Inventors: Hsin-hsien Wu, Taichung (TW); Yen-ting Chu, Taichung (TW); Chung-yi Huang, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 0 days.

(21) Appl. No.: 12/110,265

(22) Filed: Apr. 25, 2008

(51) Int. Cl.
*H01B 7/00* (2006.01)

(52) U.S. Cl. ..... 174/110 R; 174/115; 174/120 R

(58) Field of Classification Search ..... 174/110 R, 174/110 SR, 110 AR, 120 R, 120 AR, 113 R
See application file for complete search history.

(56) References Cited

U.S. PATENT DOCUMENTS

| | | | | |
|---|---|---|---|---|
| 5,258,160 | A * | 11/1993 | Utsumi et al. | 264/558 |
| 5,847,322 | A * | 12/1998 | Sakai et al. | 174/110 R |
| 6,374,126 | B1 * | 4/2002 | MacDonald et al. | 455/569.1 |
| 6,444,915 | B1 * | 9/2002 | Wang | 174/110 R |
| 6,909,050 | B1 * | 6/2005 | Bradford | 174/110 R |
| 2002/0117324 | A1 * | 8/2002 | Wang | 174/110 R |

* cited by examiner

*Primary Examiner*—William H Mayo, III

(57) ABSTRACT

A cable of easy collection includes multiple hardened sections and multiple soft sections. Each of the soft sections is disposed between each two hardened sections so that the hardened sections can overlap with each other.

14 Claims, 12 Drawing Sheets

CABLE OF EASY COLLECTION

BACKGROUND

1. Technical Field

The present invention generally relates to a cable and, more particularly, to a cable of easy collection.

2. Description of the Related Art

Nowadays, there are many kinds of electronic/electrical equipments are on market for sales. Almost each of the electronic equipments needs a signal cable to transmit digital signals for enabling the electronic equipment to exhibit sound and light effects and a power cable to deliver power for power supply. Therefore, the signal cable and power cable are essential parts for the normal operation of each of the electronic equipments.

Mobile phones and MP3 players now are the most popular and representative products of the electronic equipments and each can transmit sound signals to ears of the user by a signal cable for playing sound, so as to provide the user with experience in hearing.

FIG. 1 is a schematic view of a conventional signal cable. The conventional signal cable 1 as illustrated is an earpiece cable. One end of the signal cable 1 is a connector 2 for connecting to an electronic product and another end is a sound output portion 3 for sound output. The sound output portion 3 as illustrated is earpiece-type. Generally, the signal cable 1 includes a middle segment 4 having a predetermined length and extending from the connector 2 to the sound output portion 3, to provide the convenience of use. However, as illustrated in FIG. 2, when the signal cable 1 is collected, since the middle segment 4 is excessive long, the user usually need arbitrarily wound or fold the signal cable 1 and thus rendering inconvenient for the user. Furthermore, when the signal cable 1 is expanded for use as shown in FIG. 3, the middle segment 4 is prone to be easily tied. So repeatedly being collected and expanded, the signal cable 1 may have the possibility of being reverse-bended and even is broken resulting from the excessive pull of the user, the signal transmission efficiency of the signal cable 1 would be seriously degraded as a result. Accordingly, there is a need to overcome the above-mentioned drawbacks.

BRIEF SUMMARY

An object of the present invention is to provide a cable of easy collection.

In order to achieve the above-mentioned object, a cable of easy collection in accordance with an embodiment of the present invention is provided. The cable of easy collection includes a cable core and an insulating body surrounding the cable core. The insulating body includes multiple spaced hardened sections and multiple soft sections each arranged between each two hardened sections. Therefore the cable is endowed with segmented soft and hardened sections, which facilitates the user to effectively collect the cable by making use of the hardened sections. Furthermore, the cable can not be easily tied and entangled when being expanded for use.

Since the hardened sections can be formed by a hot stamping and hardening process, embedding an insert member between the insulating body and the cable core or forming a cover layer at the outside of the insulating body, the cable is equipped with segmented hardened sections and soft sections. As a result, the cable can achieve excellent collection effect without need additional particular parts. Accordingly, the cable not only can provide the convenience of collection for the user, but also can effectively prevent the cable from being tied or entangled.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
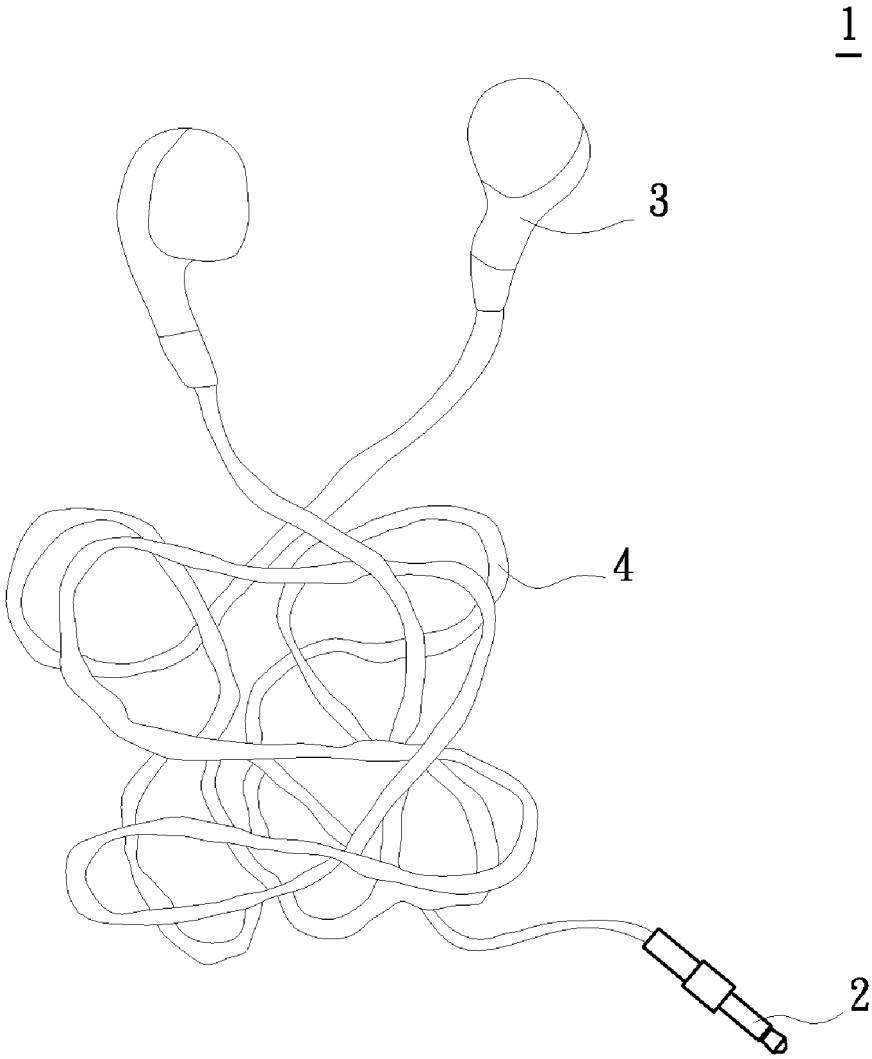
FIG. 1 (Prior Art)
FIG. 1 is a schematic view of a conventional signal cable.
Figure 2:
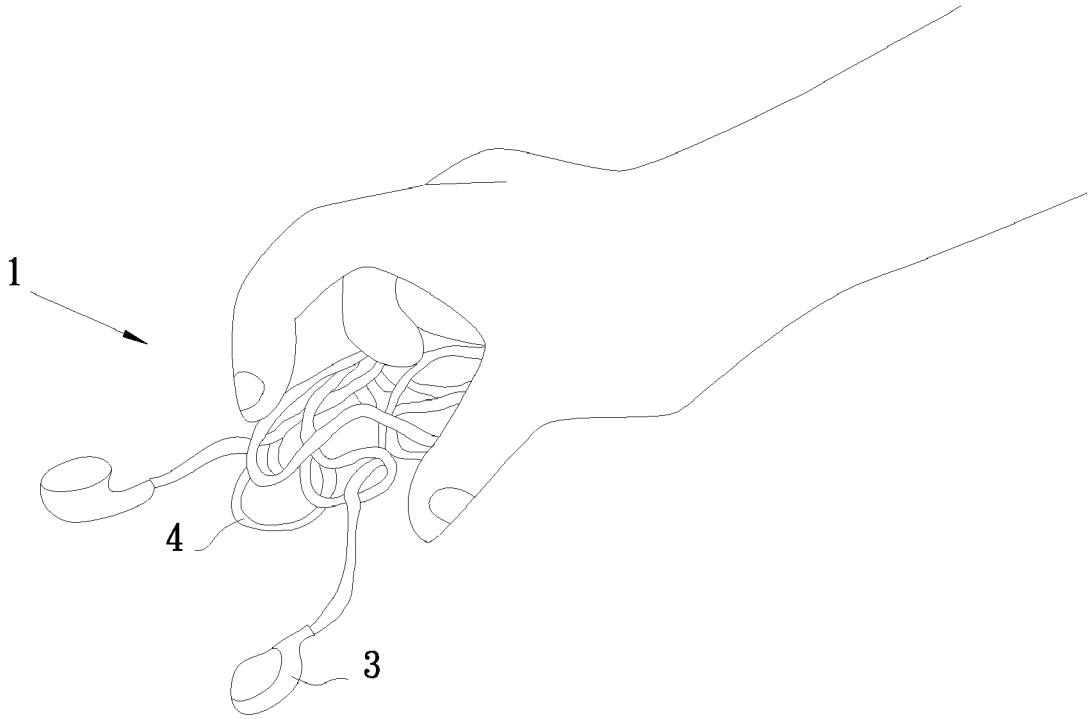
FIG. 2 (Prior Art)
FIG. 2 is a schematic view of the conventional signal cable in FIG. 1 being collected.
Figure 3:
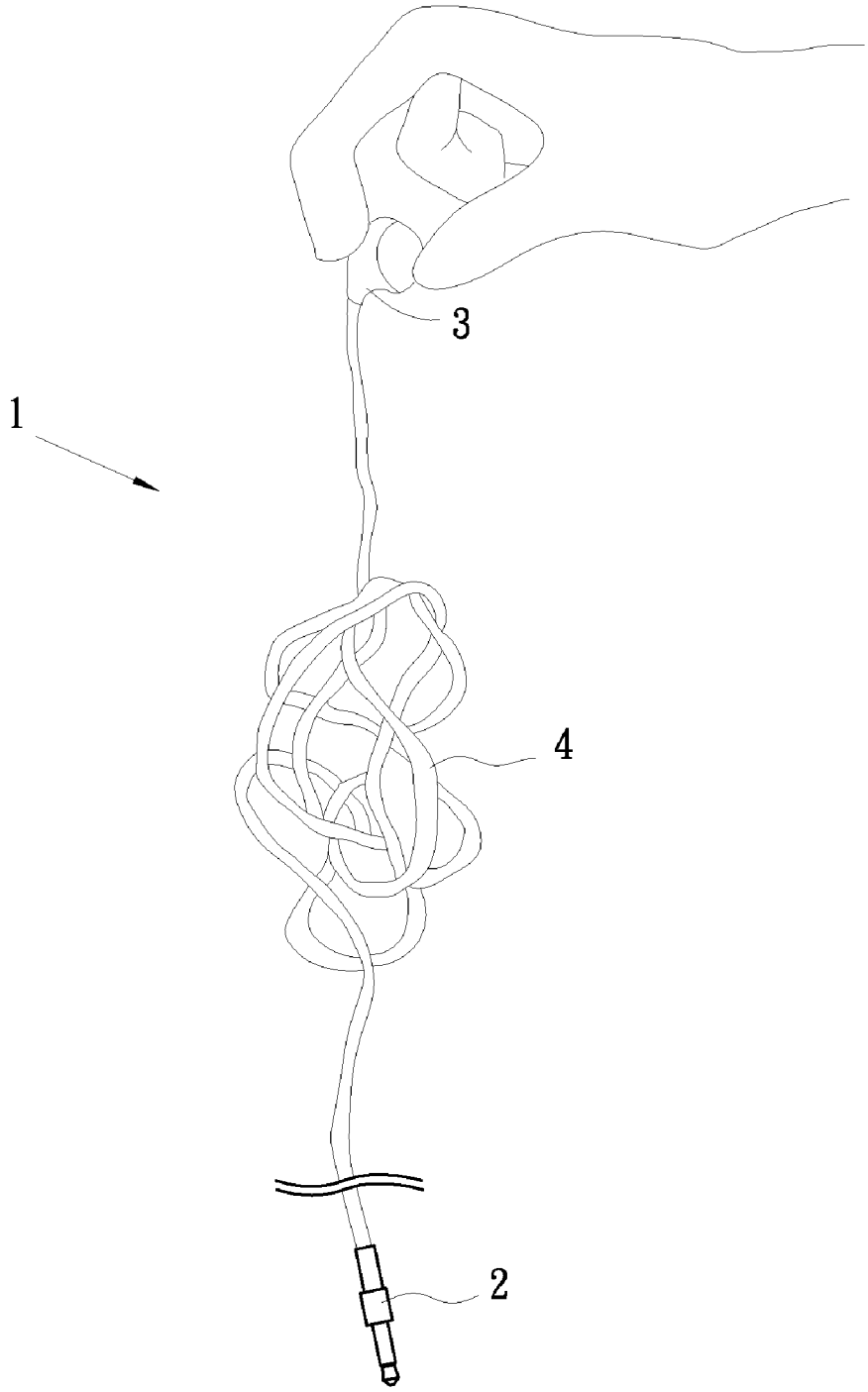
FIG. 3 (Prior Art)
FIG. 3 is a schematic view of the conventional signal cable in FIG. 2 being expanded.
Figure 4:
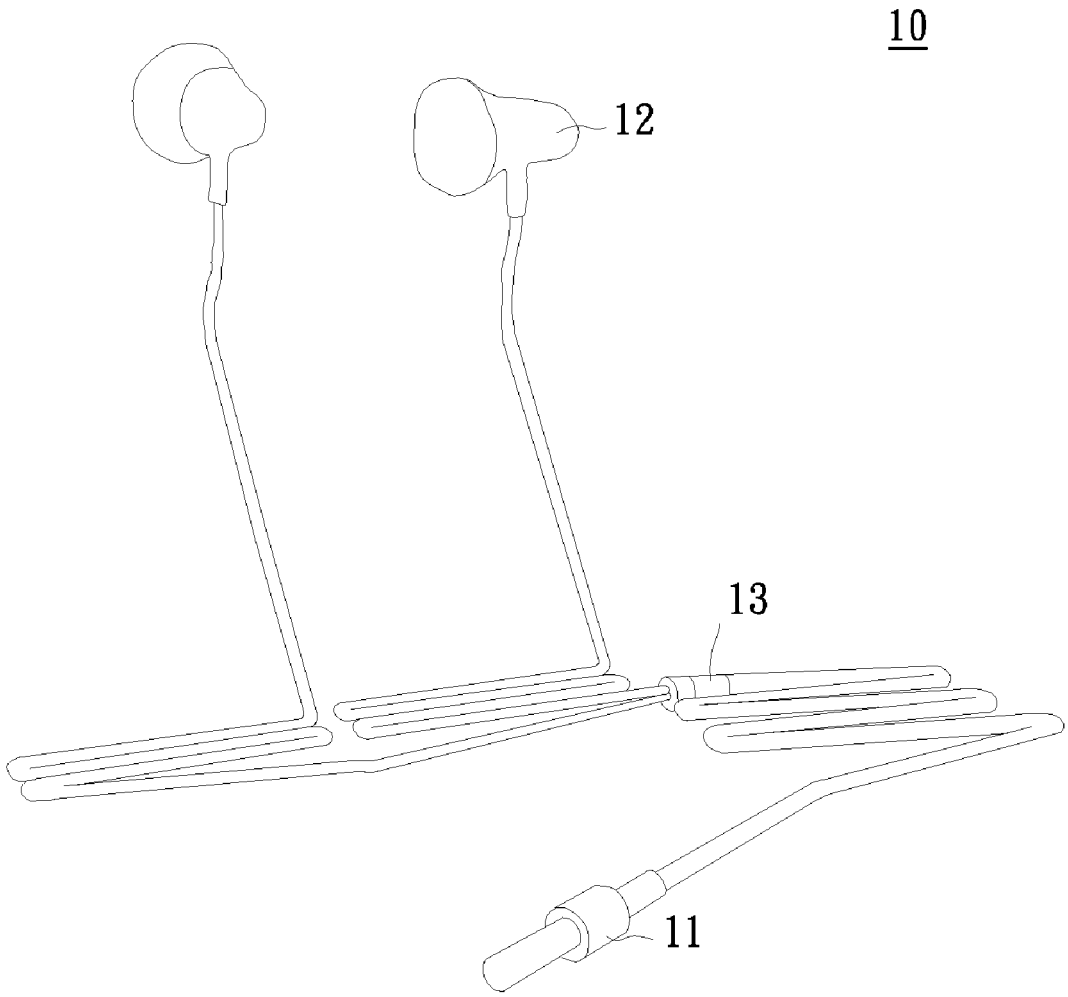
FIG. 4 is a schematic view of a cable of easy collection depicted in FIG. 4.

Referring to FIG. 4 of a schematic view of a cable of easy collection in accordance with a first embodiment of the present invention. In the first embodiment, the cable 10 is a signal cable type earpiece cable.

One end of the cable 10 has a connector 11 for connecting to an electronic equipment. The electronic equipment can be a mobile phone, a portable media player and so on. Another end of the cable 10 has a sound output portion 12. The sound output portion 12 can be earpiece-type. The connector 11 and the sound output portion 12 have a cable block 13 arranged therebetween. The cable block 13 is movably disposed at a predetermined position of the cable 10, to demarcate the cable 10 into two segments.

Figure 5:
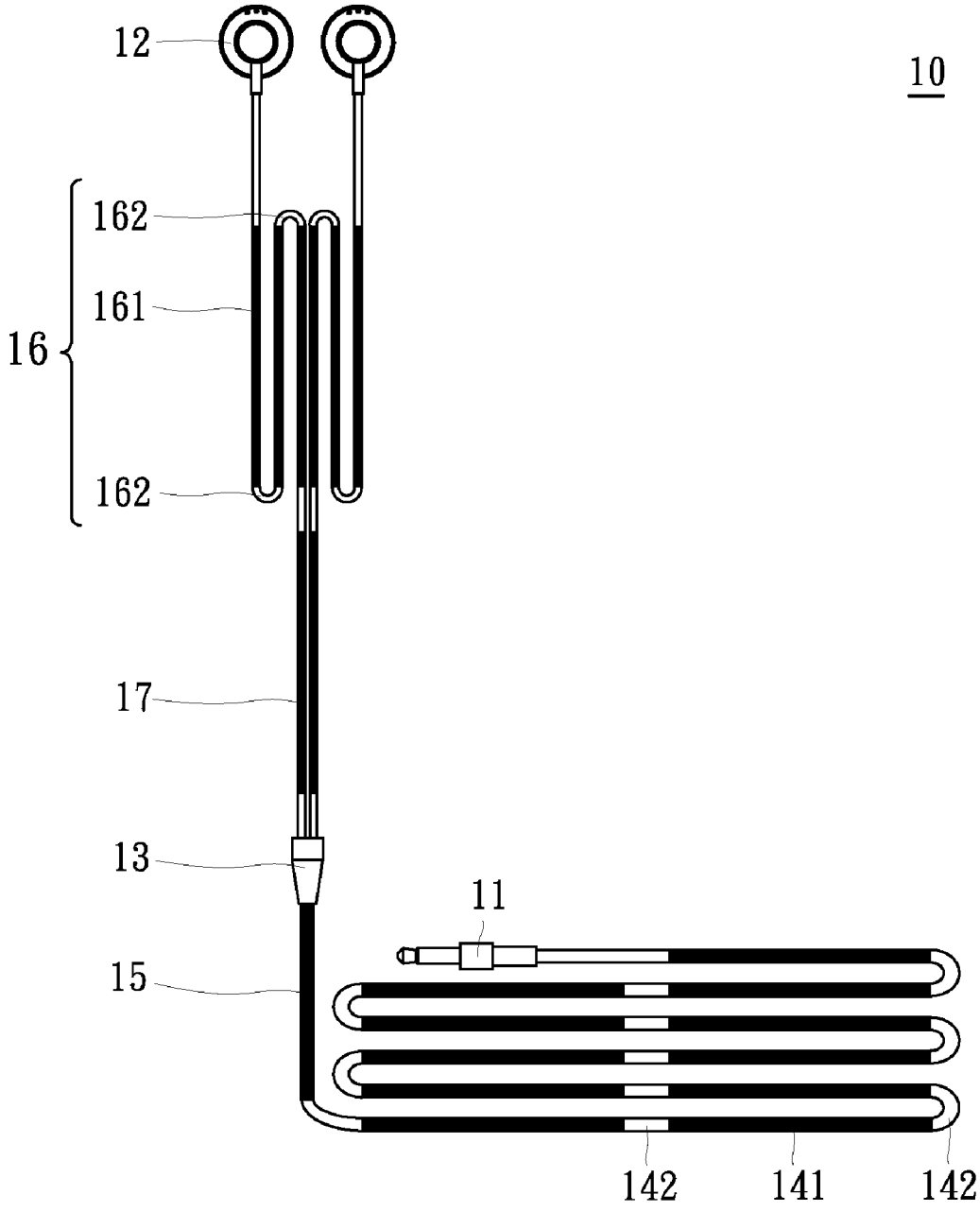
FIG. 5 is a schematic top view of the cable of easy collection depicted in FIG. 4.
Figure 6:
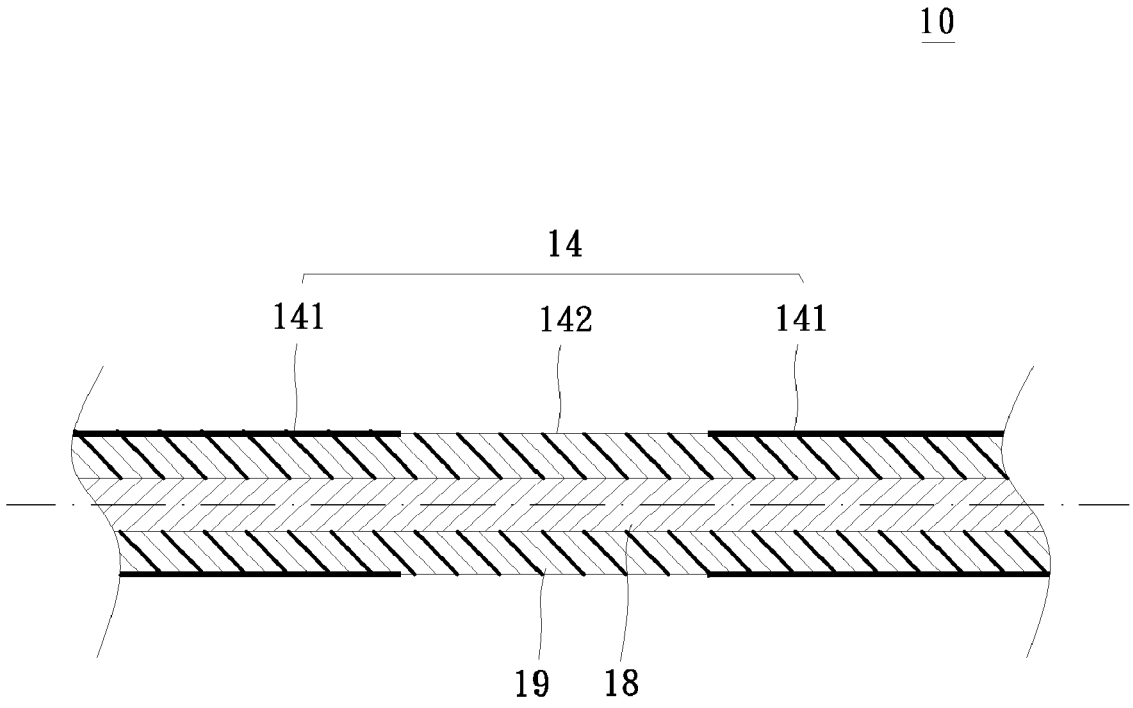
FIG. 6 is a schematic cross-sectional view of the cable of easy collection in accordance with the first embodiment.

Referring to FIGS. 5 and 6 respectively showing a top view and a cross-sectional view of the cable of easy collection in accordance with the first embodiment. The cable 10 is constituted by a cable core 18 and an insulating body 19 surrounding/encircling the cable core 18, as illustrated in FIGS. 5 and 6.

The cable 10 has a first hardened portion 14 arranged between the cable block 13 and the connector 11. The first hardened portion 14 is planar-whirling and includes multiple spaced hardened sections 141. Each two hardened sections 141 have a soft section 142 disposed therebetween. Each of the hardened sections 141 is formed by a hot stamping and hardening process. The hardness of the hardened sections 141 is relatively higher than that of the soft sections 142 and the soft sections 142 have the bendable characteristic, so that the cable 10 has segmented soft and hardened sections and thus can achieve the advantage of easy collection.

In addition, the first hardened portion 14 and the cable block 13 further have a linear second hardened portion 15 disposed therebetween.

The segment of the cable 10 from the cable block 13 to the sound output portion 12 is divided into two pieces, which facilitates the user to insert the sound output portion 12 into the left and right ears. The cable block 13 and the sound output portion 12 have a third hardened portion 16 disposed therebetween. The third hardened portion 16 is planar-whirling and includes multiple spaced hardened sections 161. Each two hardened sections 161 have a soft section 162 disposed therebetween. The bended portions of the third hardened portion 16 have the soft sections 162. Furthermore, the third hardened portion 16 and the cable block 13 have a linear fourth hardened portion 17 disposed therebetween. It is indicated that each of the soft sections 142, 162 has a length shorter than that of each of the hardened sections 141, 161.

In the first embodiment, the first hardened portion 14, the second hardened portion 15, the third hardened portion 16 and the fourth hardened portion 17 of the cable 10 all are formed by a hot stamping and hardening process, the hardness thereof is relatively higher than that of the soft sections 142, 162 and the soft sections 142, 162 have a bendable characteristic. Therefore the cable 10 exhibits segmented soft and hardened sections to achieve the advantages of easy collection and being not easily tied. It is indicated that the cable 10 can achieve the advantage of easy collection, so long as one or more than one hardened portion(s) is/are provided.

Figure 7:
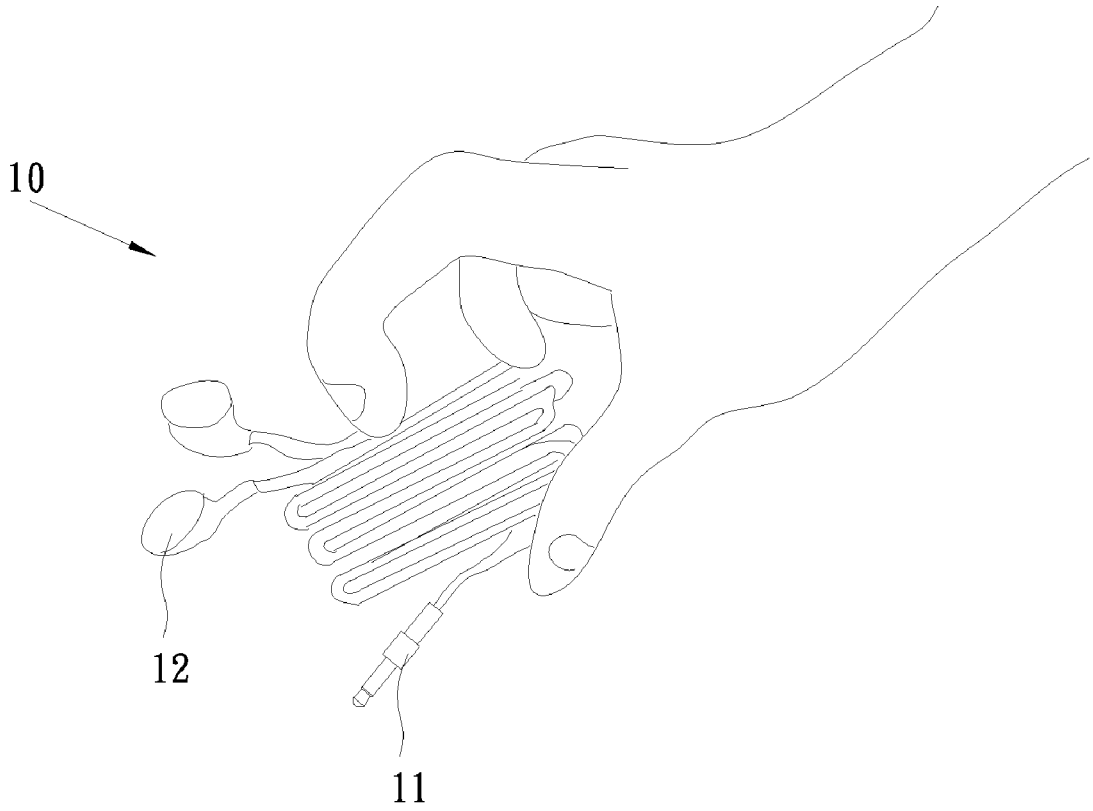
FIG. 7 is a schematic view of the cable of easy collection being collected, in accordance with the first embodiment.

Referring to FIG. 7 of a schematic view of the cable of easy collection being collected, in accordance with the first embodiment. The user can overlap each two adjacent hardened sections together by making use of the design of segmented soft and hardened sections, so that the cable 10 can exhibit a planar-whirling overlap state and achieve the collection of bulk-reduction. The collection process is much more simple and convenient for the user. Furthermore, after the cable 10 is collected, the cable 10 can be put in a suitable case or a packing receptacle to achieve the purposes of easy storage and carry.

Figure 8:
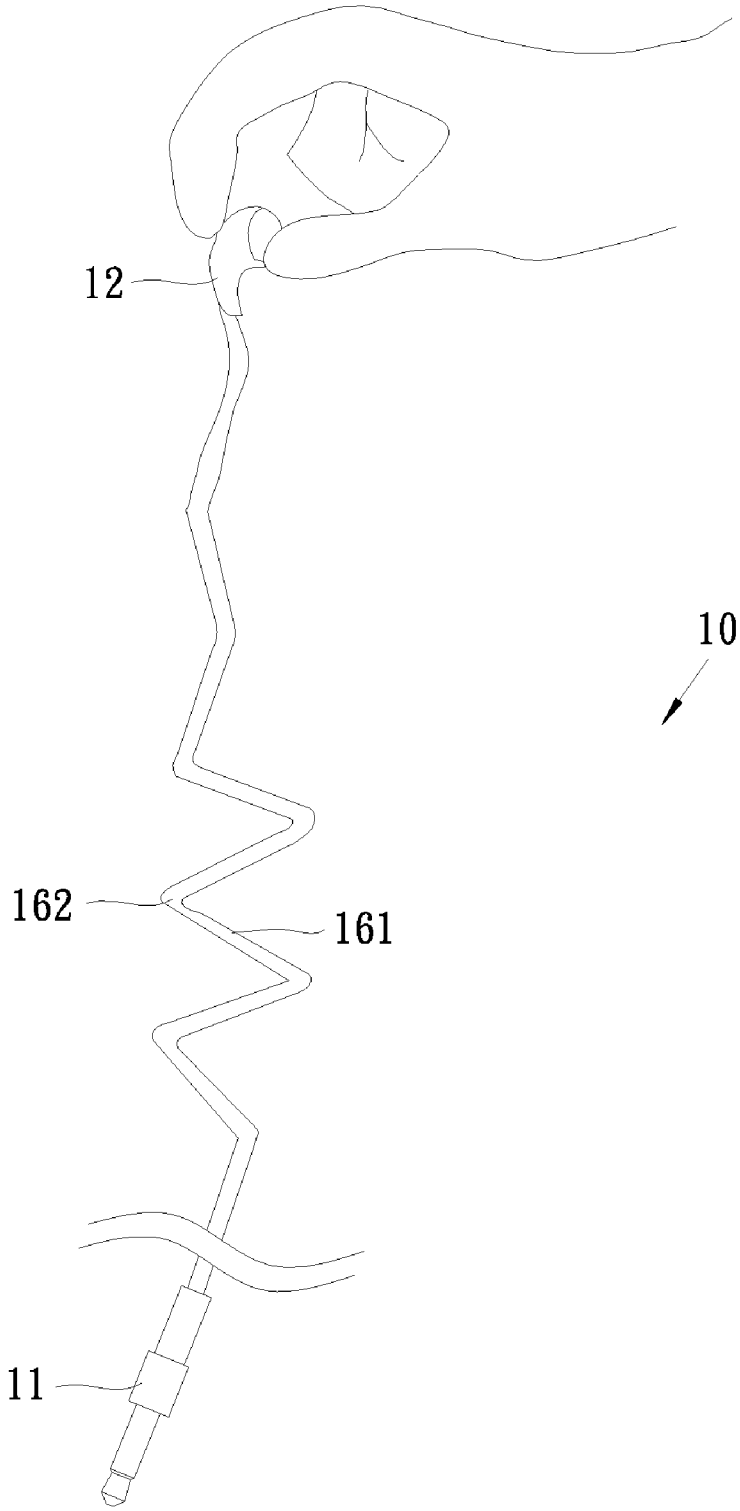
FIG. 8 is a schematic view of the cable of easy collection being expanded, in accordance with the first embodiment.

Referring to FIG. 8 of a schematic view of the cable of easy collection being expanded, in accordance with the first embodiment. As illustrated in FIG. 8, the cable 10 can be expanded by outwardly pulling the sound output portion 12. Since the hot stamped hardened sections 161 have a proper hardness and the soft sections 162 disposed at the bended portions have a proper softness, the cable 10 can not be easily tied and entangled during being expanded due to the segmented soft and hardened sections.

Figure 9:
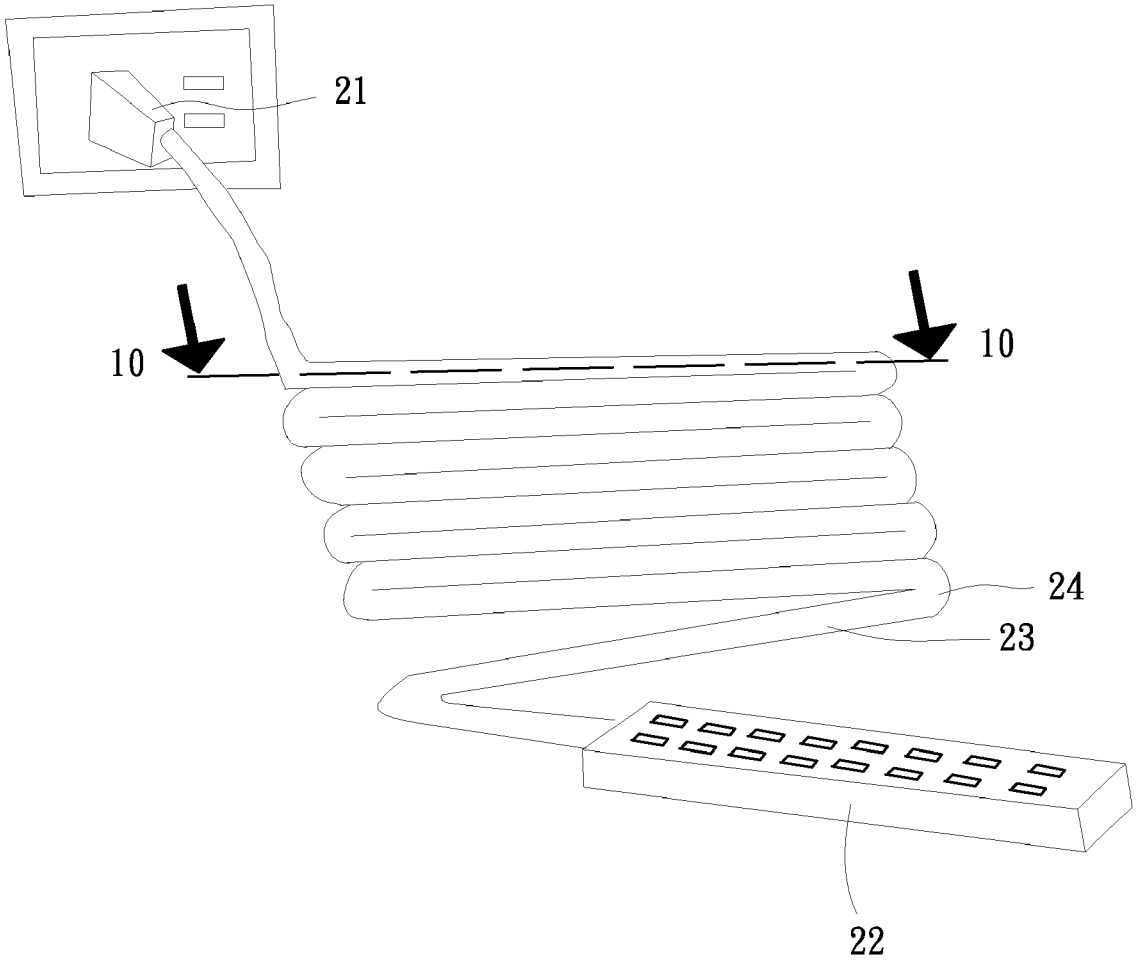
FIG. 9 is a schematic view of a cable of easy collection in accordance with a second embodiment of the present invention.
Figure 10:
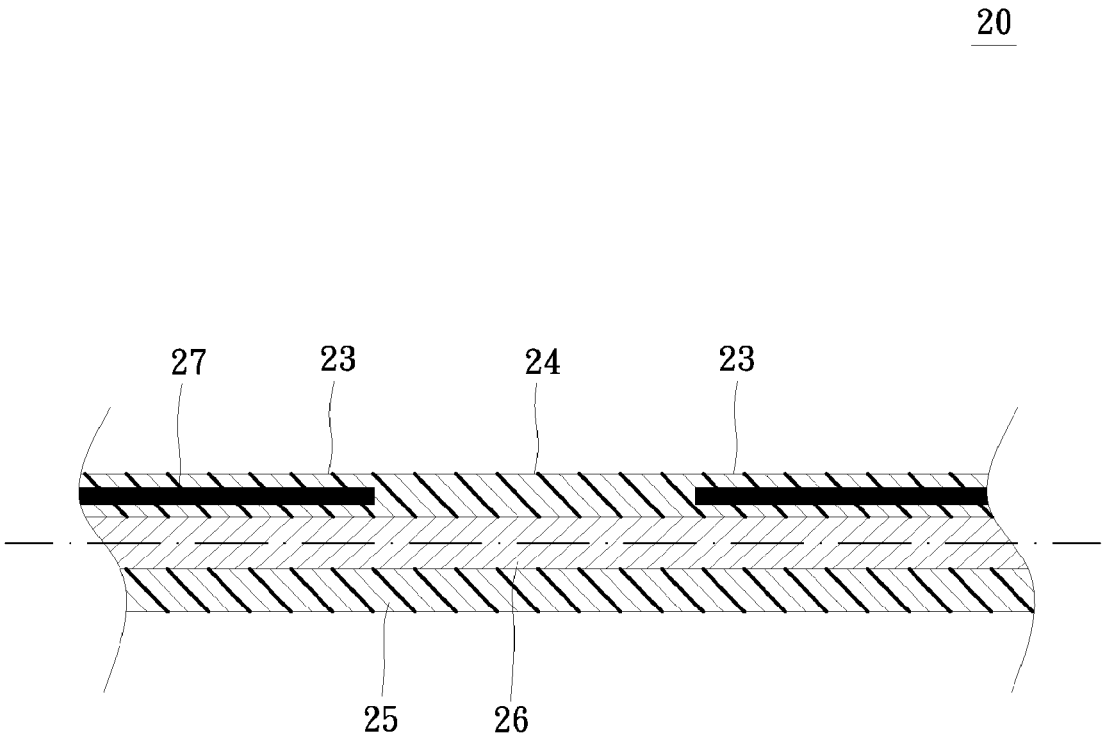
FIG. 10 is a partially longitudinal cross-sectional view of the cable of easy collection in FIG. 9, taken along the line 10-10.

Referring to FIGS. 9 and 10 showing schematic views of a cable of easy collection in accordance with a second embodiment of the present invention. In the second embodiment, the cable of easy collection is a power cable 20. The power cable 20 includes an insulating body 25, a cable core 26 and an insert member 27.

The insulating body 25 surrounds the cable core 26 and the hardness of the insert member 27 is relatively higher than that of the insulating body 25. The insert member 27 can be disposed at one side of the cable core 26 or surrounds the cable core 26, or can be ring shaped, half-ring shaped, stripe shaped and so on.

One end of the power cable 20 is a connector 21 for connecting to a power terminal, another end thereof is a socket 22. The power cable 20 includes multiple hardened sections 23 and multiple soft sections 24 and the hardened sections 23 and soft sections 24 are connected adjacent to one another. The insulating body 25 is embedded an insert member 27 in each of the hardened sections 23, so that the insert member 27 is located between the insulating body 25 and the cable core 26.

Since the hardness of the hardened sections 23 is relatively higher than that of the soft sections 24 and the soft sections 24 have the bendable characteristic, the power cable 20 is endowed with segmented soft and hardened section and thus allows the user to overlap the hardened sections 23 together. As a result, the power cable 20 is easily collected and can not be tied.

Figure 11:
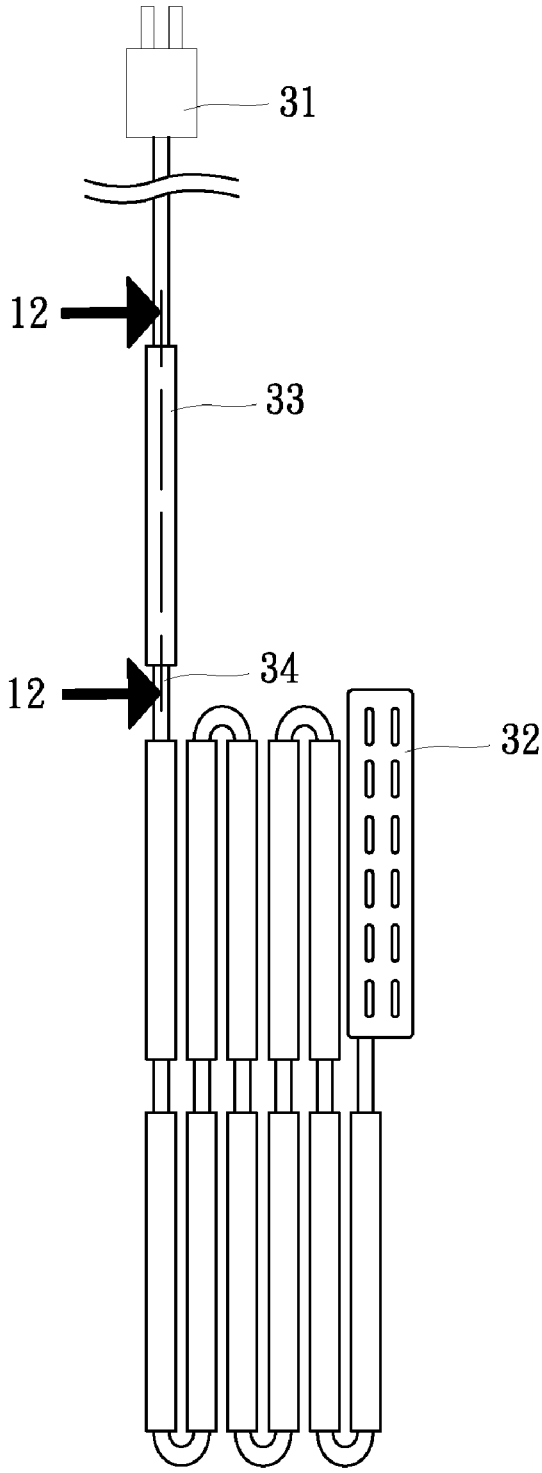
FIG. 11 is a schematic view of a cable of easy collection in accordance with a third embodiment of the present invention.
Figure 12:
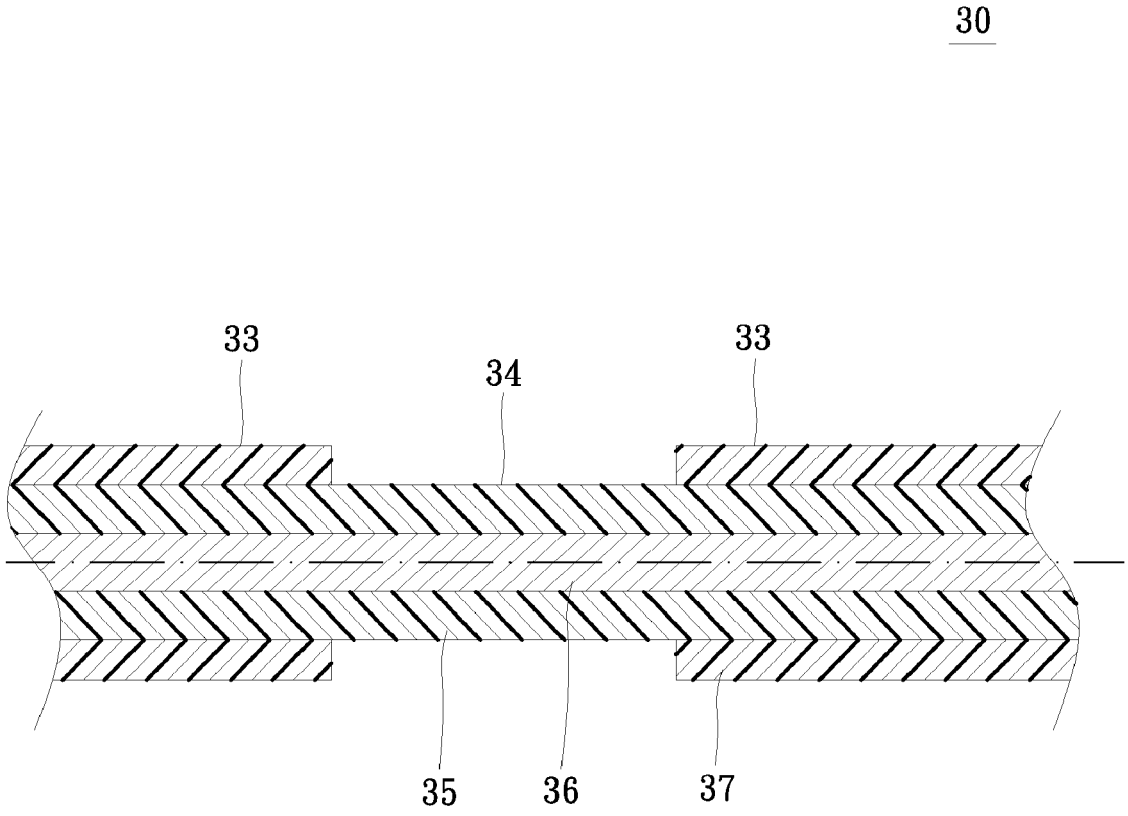
FIG. 12 is a partially longitudinal cross-sectional view of the cable of easy collection in FIG. 11, taken along the line 12-12.

Referring to FIGS. 11 and 12 showing schematic views of a cable of easy collection in accordance with a third embodiment. In the third embodiment, the cable of easy collection is a power cable 30. The power cable 30 includes an insulating body 35, a cable core 36 and a cover layer 37.

The insulating body 35 surrounds the cable core 36 and the cover layer 37 surrounds the insulating body 35. The cover layer 37 is tubular shaped or integrally formed with the insulating body 35 together.

One end of the power cable 30 is a connector 31 for connecting to a power terminal and another end is a socket 32. The power cable 30 includes multiple hardened sections 33 and multiple soft sections 34 and the hardened segments 33 and soft segments 34 are connected adjacent to one another. The insulating body 35 has the cover layer 37 formed at the outside circumference of each of the hardened sections 33. The hardness of the cover layer 37 is relatively higher than that of the insulating body 35.

Since the hardness of the hardened sections 33 is relatively higher than that of the soft sections 34 and the soft sections 34 have the bendable characteristic, the power cable 30 is endowed with segmented soft and hardened sections and thus allows the user to overlap the hardened sections 33 together. As a result, the power cable 30 is easily collected and can not be tied.

It is indicated that the insulating body 19, 25, 35 of the respective hardened sections 141, 23, 33 have the inherent plasticity which results in the hardened sections 141, 23, 33 each to be one scalable segment having small flexibility and expandable and overlappable characteristics. The soft sections 142, 24, 34 each are bendable segments can be arbitrarily bended. Therefore, when the scalable segments are in an overlapped state, the bendable segments and the scalable segments can overlap with each other to provide the convenience of easy collection and storage for the user.

In comparison with the prior art, the cable of easy collection in accordance with the present invention can be, but not limited to the signal cable or the power cable of an electronic/electrical equipment and includes multiple successively connected hardened sections and soft sections disposed between two ends of the cable. Therefore the cable can be quickly collected by overlapping the hardened sections when being collected and would not be easily tied when being expanded in the next time for use. Since the cable is endowed with the characteristic of segmented soft and hardened sections, the cable can be given a tidy whirling shape. As a result, the cable would not be over-bended in use to influence the normal use thereof.

Furthermore, the hardened sections of the cable of easy collection of the present invention can be formed by a hot stamping and hardening process, embedding an insert member between the insulating body and cable core or forming a cover layer at the outside of the insulating body. Therefore the cable is configured with segmented hardened and soft sections and thus can achieve the advantages of easy collection and being untied to meet the demand of the current industry.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A cable of easy collection, comprising:

a cable core; and an insulating body surrounding the cable core;

wherein the insulating body comprises a plurality of hardened sections and a plurality of soft sections having a bendable characteristic, each of the soft sections is disposed between each two hardened sections so that the hardened sections can overlap with each other; and wherein the insulating body has a cover layer formed at the outside of each of the hardened sections.

2. The cable of easy collection of claim 1, wherein the cover layer has hardness relatively higher than that of the insulating body.

3. The cable of easy collection of claim 2, wherein the cover layer is tubular shaped.

4. The cable of easy collection of claim 2, wherein the cover layer and the insulating body are integrally formed.

5. The cable of easy collection of claim 1, wherein one end of the cable is a connector and another end thereof is an earpiece-type sound output portion, the connector and the sound output portion have a cable block disposed therebetween, the cable block being movably arranged at a predetermined position of the cable to demarcate the cable into two segments.

6. The cable of easy collection of claim 1, wherein the cable is one of a signal cable and a power cable.

7. The cable of easy collection of claim 1, wherein a length of the soft sections is relatively shorter than that of the hardened sections.

8. A cable of easy collection, comprising:

a cable core; and an insulating body encircling the cable core;

wherein the cable comprises a scalable section and a bendable section connected to an end of the scalable section, the scalable section having expandable and overlappable characteristics, the bendable section having a bendable characteristic; when the scalable section is in an overlapped state, the bendable section and the scalable section can overlap with each other; and wherein the insulating body has a cover layer formed at the outside of the scalable section.

9. The cable of easy collection of claim 8, wherein the cover layer has hardness relatively higher than that of the insulating body.

10. The cable of easy collection of claim 9, wherein the cover layer is tubular shaped.

11. The cable of easy collection of claim 9, wherein the cover layer and the insulating body are integrally formed.

12. The cable of easy collection of claim 8, wherein one end of the cable is a connector and another end thereof is an earpiece-type sound output portion, the connector and the sound output portion have a cable block disposed therebetween, the cable block being movably arranged at a predetermined position of the cable to demarcate the cable into two segments.

13. The cable of easy collection of claim 8, wherein the cable is one of a signal cable and a power cable.

14. The cable of easy collection of claim 8, wherein a length of the bendable section is relatively shorter than that of the scalable section.

* * * * *